US005711102A

United States Patent [19]

Plaster et al.

[11] Patent Number: 5,711,102

[45] Date of Patent: Jan. 27, 1998

[54] USER CONFIGURABLE SNIPER RIFLE STOCK

[75] Inventors: John L. Plaster, Iron River, Wis.; Garth L. Choate, Bald Knob, Ark.

[73] Assignee: Choate Machine & Tool Co., Inc., Bald Knob, Ark.

[21] Appl. No.: 740,424

[22] Filed: Oct. 29, 1996

[51] Int. Cl.[6] ..... F41C 23/00

[52] U.S. Cl. ..... 42/71.01; 42/72; 42/73; 42/75.01; 42/75.02; 42/75.03; 42/97; 42/85; 42/74

[58] Field of Search ..... 42/71.01, 72, 73, 42/75.01, 75.02, 75.03, 97, 85, 74

[56] References Cited

U.S. PATENT DOCUMENTS

| | | | |
|---|---|---|---|
| 2,451,473 | 10/1948 | Cooper | 62/74 |
| 3,388,494 | 6/1968 | Kimball | 42/74 |
| 3,543,428 | 12/1970 | Bronson | 42/71 |
| 3,726,037 | 4/1973 | Wolff | 42/40 |
| 3,739,515 | 6/1973 | Koon, Jr. | 42/75 C |
| 3,830,003 | 8/1974 | Clerke | 42/75 C |
| 4,276,807 | 7/1981 | Whitlock | 89/37 BA |
| 4,470,216 | 9/1984 | Harris | 42/85 |
| 4,505,012 | 3/1985 | Johnson | 24/643 |
| 4,555,051 | 11/1985 | Johnson | 224/150 |
| 4,641,451 | 2/1987 | Harris | 42/85 |
| 4,654,993 | 4/1987 | Atchisson | 42/71.01 |
| 4,685,237 | 8/1987 | Hugg | 42/85 |
| 4,713,905 | 12/1987 | Dupuy | 42/85 |
| 4,944,109 | 7/1990 | Zedrosser | 42/71.01 |
| 5,117,735 | 6/1992 | Flashkes | 59/33.14 |
| 5,228,887 | 7/1993 | Mayer | 42/75.02 |
| 5,279,060 | 1/1994 | Watson | 42/96 |

FOREIGN PATENT DOCUMENTS

412847A1 2/1991 European Pat. Off. .

*Primary Examiner*—Charles T. Jordan
*Assistant Examiner*—Meena Chelliah
*Attorney, Agent, or Firm*—Jerry L. Mahurin

[57] ABSTRACT

Our integral user configurable sniper rifle stock comprises a wide forearm and a relatively narrow carry portion extending rearwardly from the forearm. An action mounting portion extends rearwardly from the carry portion. An angled relatively vertical, stippled grip extends rearwardly and downwardly from the receiver portion. An open rear stock portion extends rearwardly from the grip. The carry portion is narrower and thinner than the forearm. The action mounting, grip and rear portions are generally as wide as the carry portion. The forearm comprises a forend having an angled base and a flat serrated base portion extending rearwardly from the forend. A "T" channel rail is disposed within the angled base to mount a bipod. The folded legs of a bipod lie along the barrel. The grip defines a weight receptive cavity. A trigger guard extends from the receiver portion to the grip. The rear stock portion comprises upper and lower braces with a butt extending vertically between rear extents of the braces. The upper brace receives a mounting screw for a displaceable, interchangeable cheekpiece disposed about the upper brace. The lower brace has a flat serrated base. A vertically displaceable butt plate/pad and spacers are mounted to the butt. The spacers are used to adjust the length of pull of the rifle. Through-stock swivel studs are disposed through the butt and forearm. Recesses are defined in the sides of the stock about the studs.

21 Claims, 6 Drawing Sheets

USER CONFIGURABLE SNIPER RIFLE STOCK

BACKGROUND OF THE INVENTION

The present invention broadly relates to Rifle Stocks. Specifically, the present invention is a User Configurable Sniper Rifle Stock. Art pertinent to the subject matter of the present invention can be found in United States Patent Class 42 Subclasses 71.01, 72, 73 and Class D22 Subclasses 103 and 108.

Numerous patents have been issued on gun stocks and related fixtures. Some deal with the overall layout or appearance of rifle stocks, others deal with specific elements and accessories.

U.S. Pat. No. Des. 297,855 discloses the stock employed on the Ruger® 10-22 model rifle. U.S. Pat. Nos. Des. 304,223 and 4,674,216 deal with synthetic stocks with inserts. These latter two patents are also owned by Sturm, Ruger & Company, Inc.

Different configurations for the forearm portion of a stock appear throughout the prior art. Campos, U.S. Pat. No. 4,790,095 discloses a relatively basic rifle stock having a rearward extending brace. This stock employs a relatively broad forearm with a flat base. A square forearm with a flat base is disclosed in Bronson, U.S. Pat. No. 3,543,428. An angled forearm is disclosed in Straub, U.S. Pat. No. 4,473,964.

Zedrosser, U.S. Pat. No. 4,944,109 and Davis, U.S. Pat. No. 5,048,215 disclose pistol grips at the trigger and swivels. Another swivel is disclosed in Hugg, U.S. Pat. No. 4,685,237. The stud for this swivel is flush when not in use but still protrudes during use.

Adjustable cheekpieces are disclosed in Dabrowski, U.S. Pat. No. 5,149,899; Hickman, U.S. Pat. No. 4,203,244; and Frómming, U.S. Pat. No. 4,430,822. Dabrowski discloses an interchangeable and adjustable comb. Hickman is a combination butt pad and cheekpiece. Frómming is a modular firearm with a generally rectangular cheekpiece. The U.S. Army's M24 rifle system has a butt that can be cranked in or out and locked in position.

Harris, U.S. Pat. No. 5,074,188 and Anschütz, U.S. Pat. No. 4,242,826 disclose "T" rails disposed under forearms. Harris is a flexible bipod mount. The "T" rail is defined in a bracket flexibly mounted to the underside of a rifle stock forearm.

Eberle, U.S. Pat. No. Des. 346,846, Zelzer, U.S. Pat. No. Des. 299,943 and Grandy, U.S. Pat. No. 3,618,249 each illustrate firearms with openings in the stocks. Choate Machine and Tool Company, Inc. Folding Stock for an HK 91 (Part No. 15-01-02) is another example of an open stock.

Many elements employed in rifle stock design are old in the art and are in the public domain. However, a unique combination of element desirable for use by those charged by military and police forces with carrying out sniper missions are embodied by the present invention.

A proper stock is the foundation for precision shooting. It is the interface between the rifleman and the rifle's action and barrel. For absolute peak performance, it should conform to, and be an extension of the rifleman's body. Preferably the butt should be adjustable for overall length and height. Also, the height and position of the cheekpiece should be adjustable. Both adjustments are critical for correct eye relief, proper eye alignment with the scope, developing a spotweld (consistent positioning of the cheek against the stock), and shouldering the rifle for consistent aiming and recoil absorption. A shooter can tell when the butt length is improper if he finds himself "turkey necking," or moving his head backward or forward to obtain correct eye relief.

The cheekpiece should be of sufficient height that the sniper's eye is aligned with the scope while his cheek is held on the stock at his natural spotweld. Prior art methods for augmenting cheekpieces include strap on leather cheekpieces and a cheekpiece that can be firmly cranked up or down. Open sight rings are employed by many shooters to allow use of the rifle's fixed sights as well as the scope. Scopes mounted on rings are generally higher than directly mounted scopes. Therefore, a raised or thicker cheekpiece is necessary for proper eye-scope alignment. A shooter can tell his cheekpiece height is improper, if he is "goose necking" or moving his head up or down in order to align his eye with the scope.

When butt length and cheekpiece height are adjusted correctly, a shooter should be able to throw his rifle to his shoulder naturally and find perfect eye alignment with the scope. He should neither "turkey neck" nor "goose neck" to get a sight picture. The result is not only more comfortable and accurate shooting, but improved reaction speed.

More than any other accessory or attachment, the bipod helps long-range riflemen improve their shooting performance. A bipod adds great stability, much more steadiness than anything except sandbags, for support. In essence, with a bipod a shooter carries his prone support with him. Employing a bipod also allows a shooter to raise his rifle above grass and shrubs without diminishing steadiness. The most popular bipods are lightweight, tubular units. Many models are adapted to mate with a "T" rail for convenient mounting, positioning and dismounting. Generally these the legs of these bipods fold forward when not in use and employs spring tension to help lock them down when rotated into place. They usually have telescopically extensible, spring-loaded legs having push button releases and locks.

Swivel studs are absolutely essential for attaching a sling. Most snipers prefer to use quick-release swivels. A sniper primarily uses a sling as a stabilizer to improve offhand, sitting, and kneeling shooting. The sling may be constructed of leather or nylon. A sniper does not primarily employ a rifle sling as a carrying strap. A sling is designed to brace the shooter for steadier, more accurate shooting. However, a sling is also a means by which a sniper can carry his weapon if the situation demands, such as when one needs his hands free or while crawling.

Rough checkering or nubs on the pistol grip and forearm are desirous to provide positive control. In the forearms, a wide, flat base reduces lateral wobble and improves supported firing stability. However, it is also desirous for the forearm's bottom to have a taper so the shooter can raise or lower elevation merely by sliding the rifle forward or pulling it back on a supporting surface.

Hence, on rare occasions professional sniper's have a stock custom-built to reflect their body size and shape. However, it is desirable that a more practical alternative be made available. The desirable sniper rifle stock would be adjustable at the strategic points of body contact, the rifle butt and cheekpiece. Additionally, this stock should provide a bipod mount and other desirous features such as sling swivels, a heavily stippled grip and a forearm with a wide stable base along with an angled portion.

SUMMARY OF THE INVENTION

Our User Configurable Sniper Rifle Stock is a practical alternative to custom made sniper rifle stocks. It employs an adjustable butt plate which will allow a user to not only adjust the length of pull (LOP) of his rifle but also the butt plate's vertical position relative to the stock. The cheekpiece is readily replaceable allowing a user to use a cheekpiece which is of appropriate thickness. Additionally, a thicker cheekpiece can be installed if the shooter employs scope rings. The cheekpiece is also adjustable forward and rearward along the comb of the stock. Our stock also provides mounting for a bipod; a wide, flat based forearm with both angled and flat portions; a heavily stippled grip; and through-stock sling swivels.

Traditionally snipers have preferred oil-rubbed wooden stocks. However the present invention is a quality stock manufactured of synthetic material. The use of a material such as Dow® Rynite® overcomes traditional problems with flimsiness in synthetic stocks.

The forearm of our stock is relatively wide, wider than the rest of the rifle stock, and has a flat base. A "T" rail commonly refereed to as a "Anchütz type "T" Rail" is disposed on the base of the forward portion of the forearm. This fore portion of the stock forearm is gently angled. The preferred embodiment employs an angle of approximately ten degrees. This angle has several advantages. An angled forearm allows a shooter to adjust elevation by sliding the angled portion of the forestock forward and back on a support, such as a chair back or window frame. By positioning the "T" rail in the forward portion of the forestock, our stock also deploys the "T" rail at an angle. This allows a bipod mounted to the rail to be folded upward, angled toward the barrel, preventing snagging of the bipod legs during movement through underbrush and the like. Additionally the angled "T" rail allows for fine tuning of a bipods elevation in addition to the bipod's own adjustibility. Balance of the rifle about the bipod can also be adjusted by moving the bipod forward and rearward along the rail. The "T" rail can also mount an "off-hand" pistol grip for free shooting which can be adjusted forward and rearward as desired.

The rear portion of the forearm is flat, generally parallel to the rifle's barrel, to provide grater stability when a bipod is not employed or cannot be employed and the forearm is rested upon a supporting surface for stability. Serrations, generally perpendicular to the barrel, are defined in the rear portion of the forearm. The serrations insure that the rifle does not slip prior to a shot.

Rear of forearm the stock narrows in width. The height, or thickness, of the stock is reduced immediately rearward of the forearm, which in conjunction with the narrower stock provides a one hand carry portion at or near a rifle's balance point. As mentioned above the entire stock, rear of forearm is narrower. Preferably this width is approximately one and one half inches.

The action mounting portion of the stock, mounts the rifle's action. It has the same width as the carry portion. However, it is thicker in height. A trigger guard extends from the receiver portion to a pistol grip portion.

Our stock employs a heavily stippled pistol grip to provide positive control over the rifle. The grip is disposed at a rearward angle slightly off vertical. In the preferred embodiment this angle is approximately ten degrees. Preferably the grip is hollow to allow a balancing weight to be disposed within. The weight can be varied as desired or as needed for barrel length. Many experienced shooters feel that a synthetic stock is overly lightweight. The weight disposed within the grip can be used to offset this problem while providing the advantages of a synthetic stock; durability, strength, and weather resistance. Also, by increasing the weight of the rifle, recoil is dampened. The weight can be epoxied or similarly fixed in place to prevent shifting. The grip cap screws are counter sunk for flush mounting to avoid snagging.

The rear portion of the stock is open. This allows the user to fully grip the pistol grip and reduces the overall weight of the stock. The open portion is defined by generally parallel upper and lower braces. A butt portion extends between the rear extents of the braces. The upper brace mounts the cheekpiece and the lower brace defines a relatively flat base generally parallel with the rifle's bore. The flat base of the lower brace is serrated similar to the flat portion of the forearm. The butt portion of the open stock is generally vertical providing an off hand hold notch. By being generally vertical the off hand hold notch allows a shooter to exert even pressure with his off hand, to tightly hold the butt of the stock against his shoulder, while having a comfortable hand position.

As mentioned above, the stock's butt plate or pad is adjustable. The thickness of the butt plate can be adjusted by installing spacers between the rear of the stock's butt portion and the butt plate or pad. The vertical position of the stock's butt plate and any accompanying pad is also adjustable. Uniformly spaced mounting holes defined in a plate embedded in the butt portion provide a plurality of mounting positions for the buttplate and/or pad vertically.

Also mentioned above, our stock employs interchangeable cheekpieces. A thicker cheekpiece can be employed if the shooter prefers to employ scope rings. Scope rings are often employed to allow the use of open sights on a rifle mounting a scope. The cheekpiece is also adjustable forward and rearward. Multiple mounting holes are defined along the top of the comb of the stock, in the upper brace, for receiving a central bolt through the cheekpiece. Only a single bolt is needed as the cheekpiece partially wraps around the comb, holding it in place laterally.

Novel through stock swivel studs are flush mounted in recesses for superior strength and performance. The through stock swivels horizontally pass through the stock allowing a sling to be disposed along the length of the stock. A sling so disposed allows the relatively flat stock, mounting a rifle, to be carried relatively flat against a shooters back. This provides greater maneuverability through underbrush, heavy vegetation or the like. The sling so mounted allows easier wrapping to provide stability. By passing entirely through the stock the swivels allow a sling to be mounted to either side of the stock as preferred by the user. Another advantage presented by the through stock swivel is superior strength. The swivels for conventional stocks are mounted in place by a screw or stud screwed directly into the material of the stock. Our swivels are disposed within recesses. The recesses, and swivels are preferably disposed in the forward portion of the forearm and in the butt portion. These recesses keep the swivel heads retracted to help prevent snagging both when in use and when not in use.

Therefore, a primary object of the present invention is to provide a user configurable sniper rifle stock.

More specifically an object of the present invention is to provide an integral rifle stock mounting user configurable attachments such as an adjustable butt pad or plate and cheekpiece.

An object of the present invention is to provide a sniper rifle stock having an angularly disposed Anchütz type "T" Rail for mounting a bipod in such a manner that when the bipod is folded, the legs of the bipod are angled toward the barrel of the rifle to prevent inadvertent snagging.

An object of the present invention is to provide a sniper rifle stock having a forearm with a coarsely serrated flat surface generally parallel to the barrel of the rifle.

An object of the present invention is to provide a sniper rifle stock having a rear portion with a coarsely serrated flat surface generally parallel to the barrel of the rifle.

An object of the present invention is to provide a sniper rifle stock in which the forward portion of the forearm is angle to allow sliding elevation adjustment.

An object of the present invention is to provide a sniper rifle stock in which the grip and the area around it are heavily stippled.

An object of the present invention is to provide a sniper rifle stock in which the grip defines a weight receptive cavity.

An object of the present invention is to provide a sniper rifle stock using a weight to balance the stock.

An object of the present invention is to provide a sniper rifle stock in which the area rear of forearm is narrower in width and height than forearm for one hand carrying at the rifle's balance point.

An object of the present invention is to provide a sniper rifle stock in which the entire stock rear of forearm is narrow.

An object of the present invention is to provide a sniper rifle stock in which the length of pull of the rifle is adjustable.

A related object of the present invention is to provide a sniper rifle stock in which the thickness of the butt plate is adjustable.

Another related object of the present invention is to provide a sniper rifle stock in which the butt plate or pad is adjustable vertically.

An object of the present rifle stock is to provide a plurality of uniformly spaced mounting holes for the butt plate or pad.

An object of the present invention is to provide a sniper rifle stock with interchangeable cheekpieces.

A related object of the present invention is to provide a sniper rifle stock with relatively thick interchangeable cheekpieces for use with scope rings.

A further related object of the present invention is to provide a sniper rifle stock with a cheekpiece which is adjustable forward and rearward using multiple mounting holes.

An object of the present invention is to provide a sniper rifle stock with a relatively wide forearm with a flat base for stability.

A related object of the present invention is to provide a sniper rifle stock with a serrated forearm base to help prevent slippage.

An object of the present invention is to provide a sniper rifle stock with a relatively wide forearm with an angled portion to allow sliding elevation adjustment and a flat portion for stability on a supportive surface.

An object of the present invention is to provide a sniper rifle stock with through-stock swivel studs flush mounted in recesses.

An object of the present invention is to provide a sniper rifle stock with an open rear stock portion.

A related object of the present invention is to provide a sniper rifle stock having an open rear stock portion with a serrated base to help prevent slippage.

An object of the present invention is to provide a sniper rifle stock with a generally vertical off hand hold notch.

An object of the present invention is to provide a sniper rifle stock with a serrated base to help prevent slippage.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
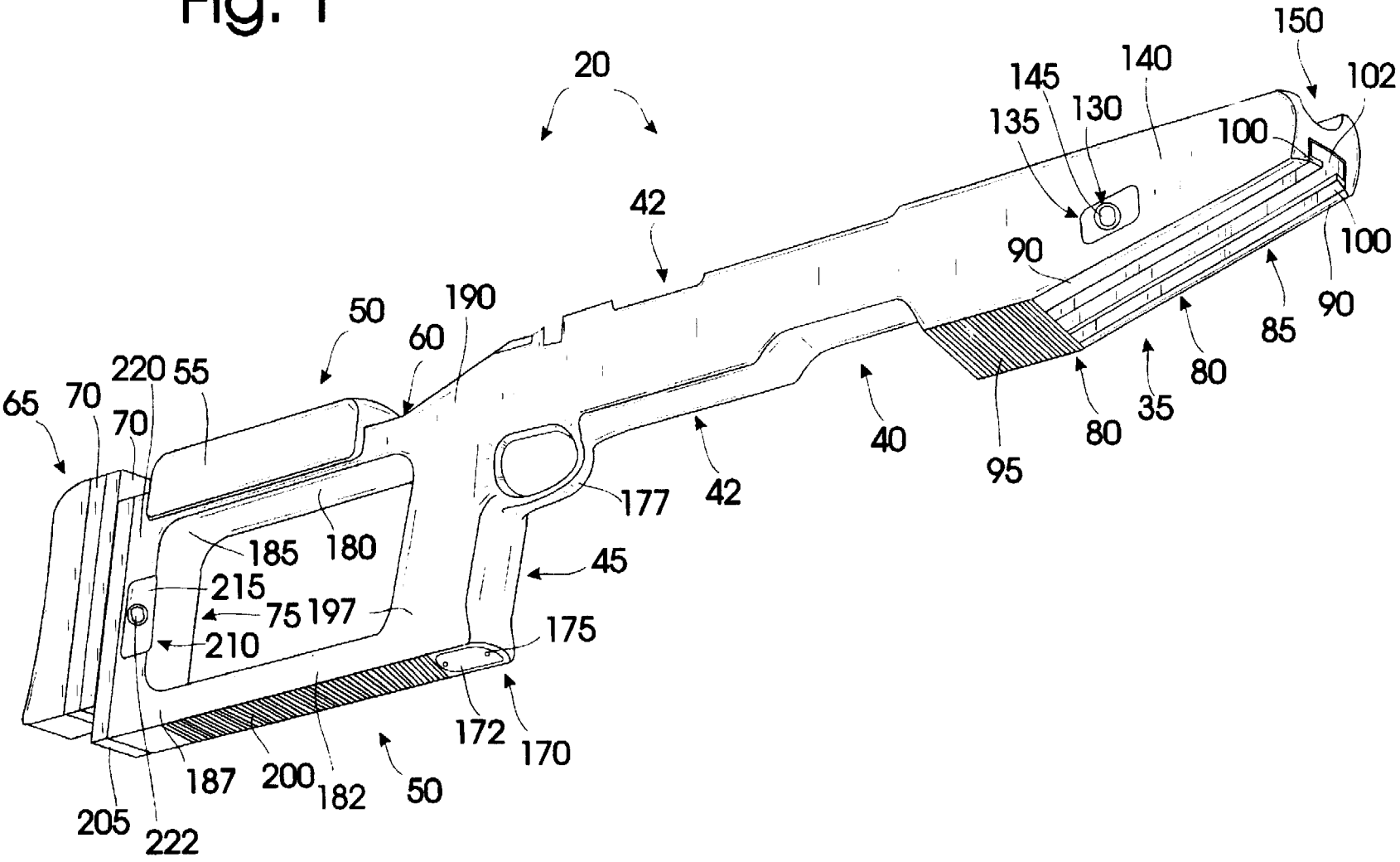
FIG. 1 is an isometric view of our User Configurable Sniper Rifle Stock.
Figure 2:
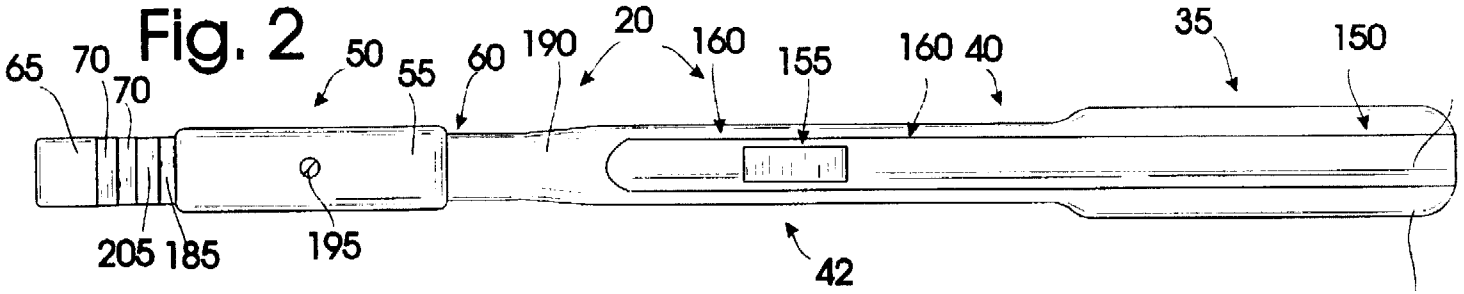
FIG. 2 is a top plan view of our rifle stock.
Figure 3:
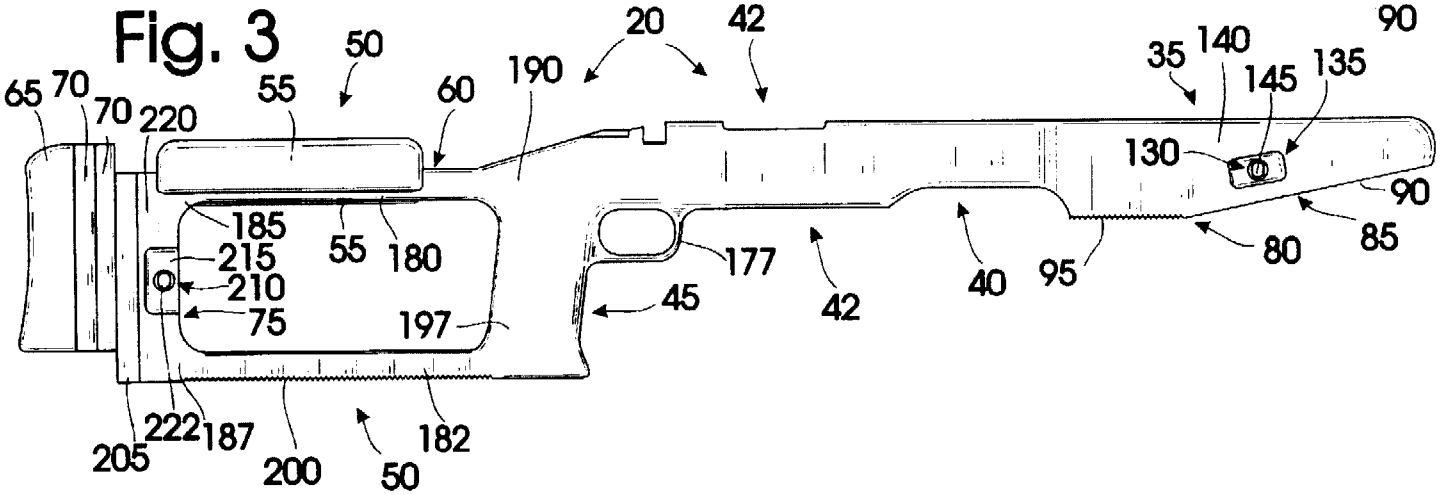
FIG. 3 is a side elevational view of our rifle stock.
Figure 4:
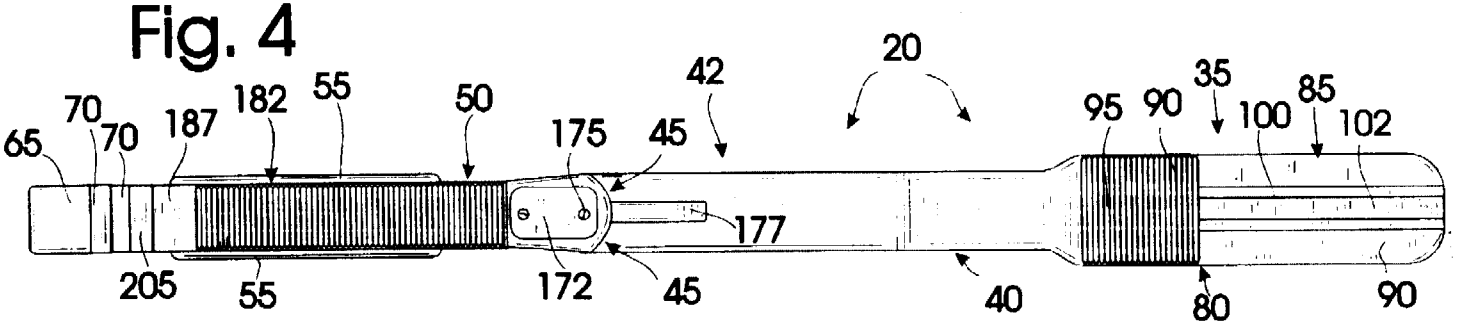
FIG. 4 is a bottom plan view of our rifle stock.
Figure 7:
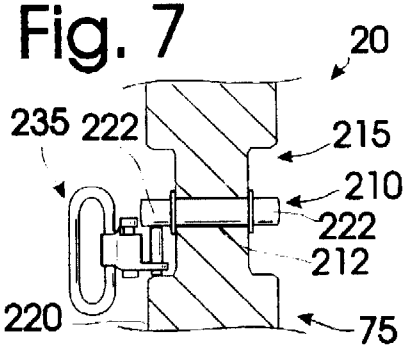
FIG. 7 is a partially fragmented view of the butt portion swivel stud and orifice with an open swivel disengaged from the swivel stud.
Figure 6:
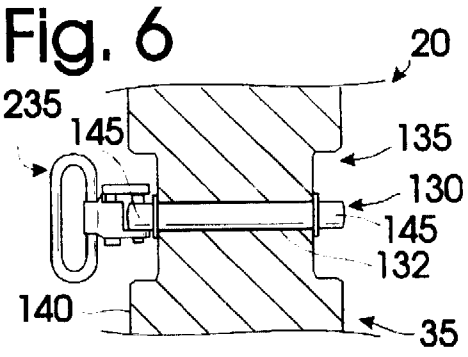
FIG. 6 is a partially fragmented view of the forearm swivel stud and orifice with a closed swivel engaging the swivel stud.
Figure 5:
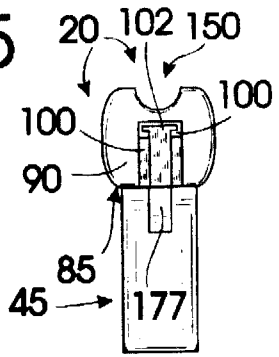
FIG. 5 is a front elevational view of our rifle stock.
Figure 8:
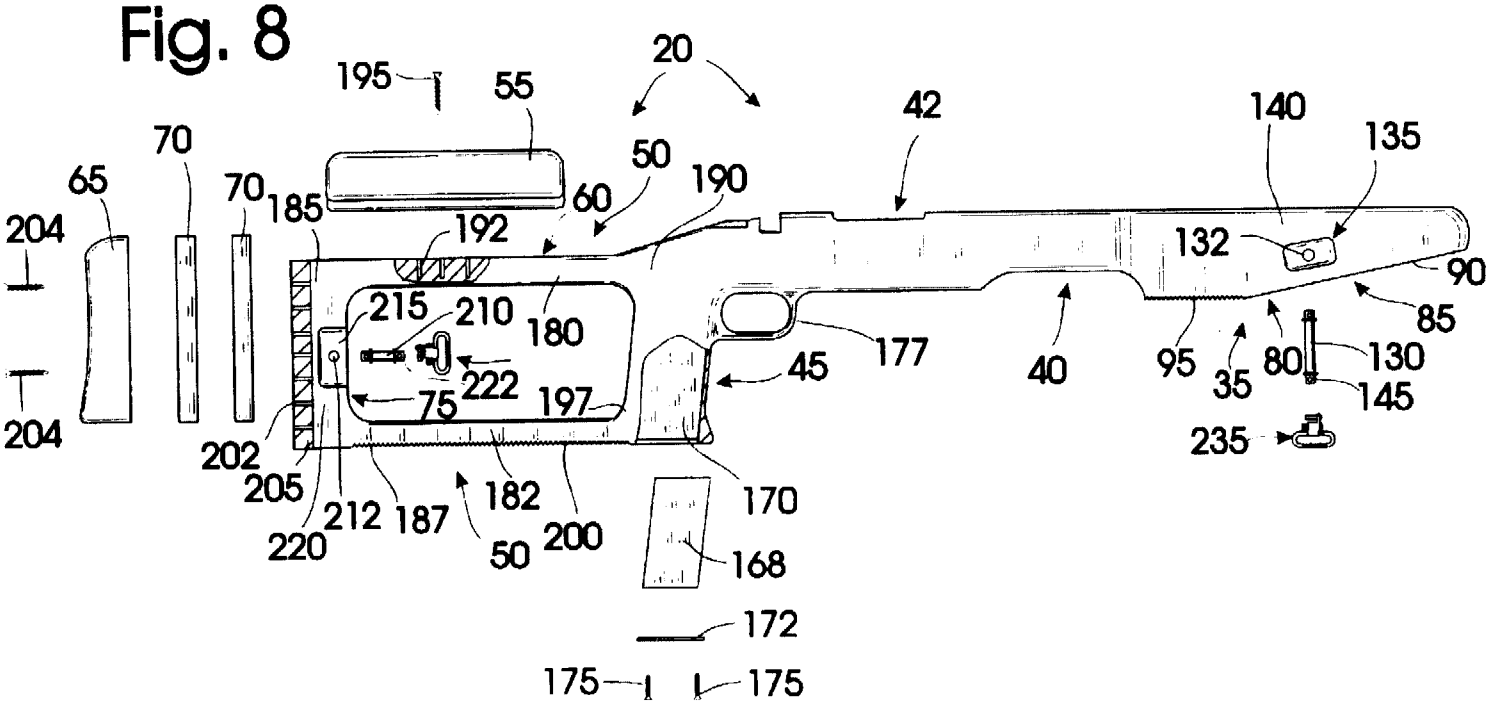
FIG. 8 is a partially fragmented, exploded side elevational view of our rifle stock.
Figure 9:
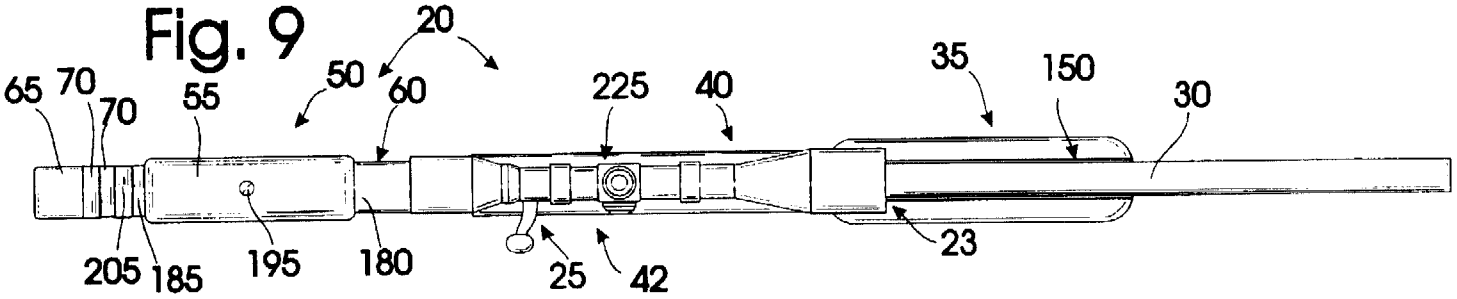
FIG. 9 is a top plan view of our rifle stock mounting a typical rifle and scope.

With reference now to the accompanying drawings, the preferred embodiment of our User Configurable Sniper Rifle Stock is broadly designated by the reference numeral 20. It is intended to mount a rifle 23, including the action 25 and barrel 30, and is constructed of a synthetic material which is lightweight, durable and weather resistant, such as a polyester-elastomer blend. Our stock 20 is generally integral comprising a relatively wide forearm portion 35, a narrower carry portion 40, an action mounting portion 42, a grip portion 45 and an open rear stock portion 50. A user interchangeable, adjustable cheekpiece 55 is disposed on the comb 60 of the rear portion 50 and a vertically displaceable butt plate or butt pad 65 with replaceable spacers 70 are disposed on the butt portion 75 of the rear portion 50.

Figure 10:
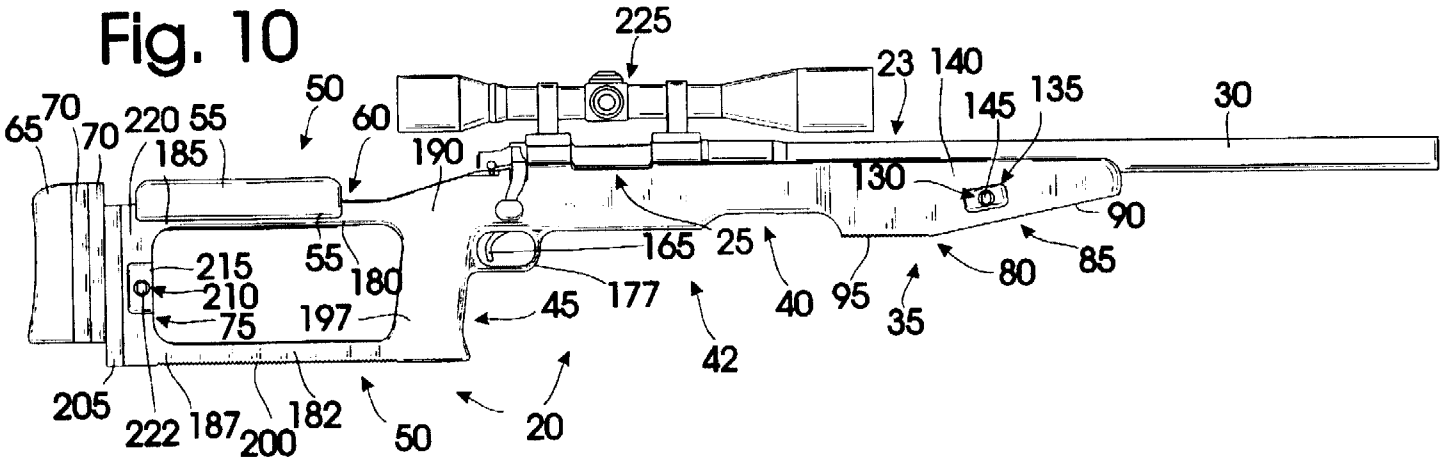
FIG. 10 is a side elevational view of our rifle stock mounting a typical rifle and scope.
Figure 11:
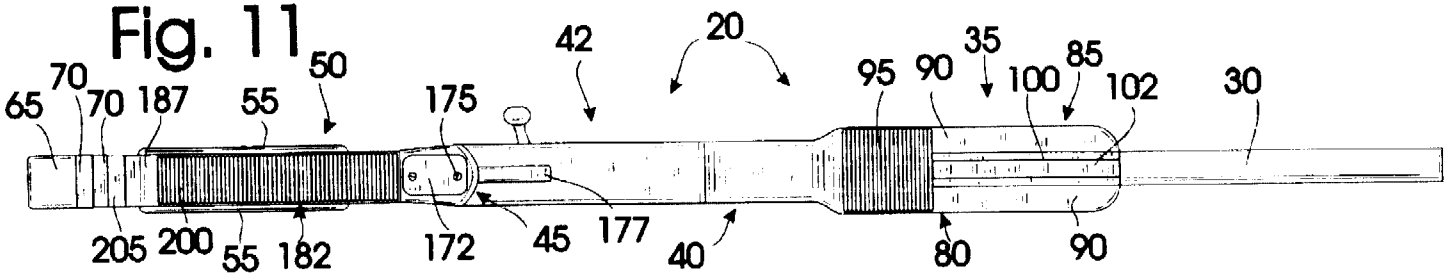
FIG. 11 is a bottom plan view of our rifle stock mounting a typical rifle and scope.
Figure 12:
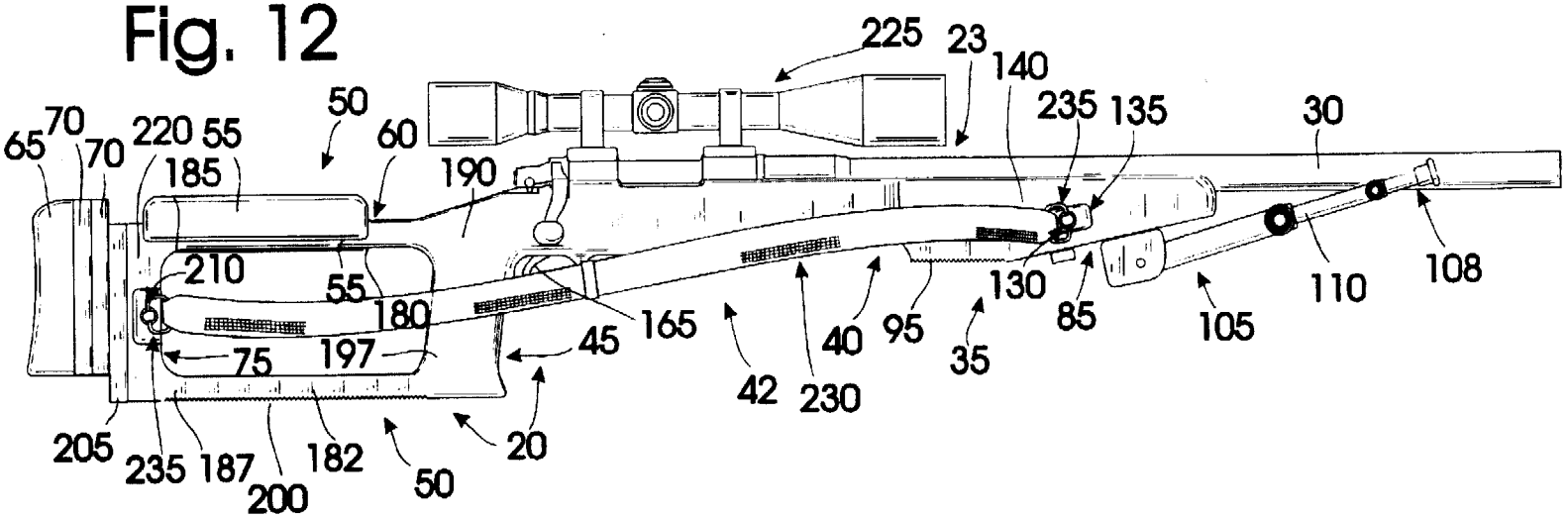
FIG. 12 is a side elevational view of our rifle stock mounting a rifle, scope, sling and bipod, with the bipod legs retracted.
Figure 13:
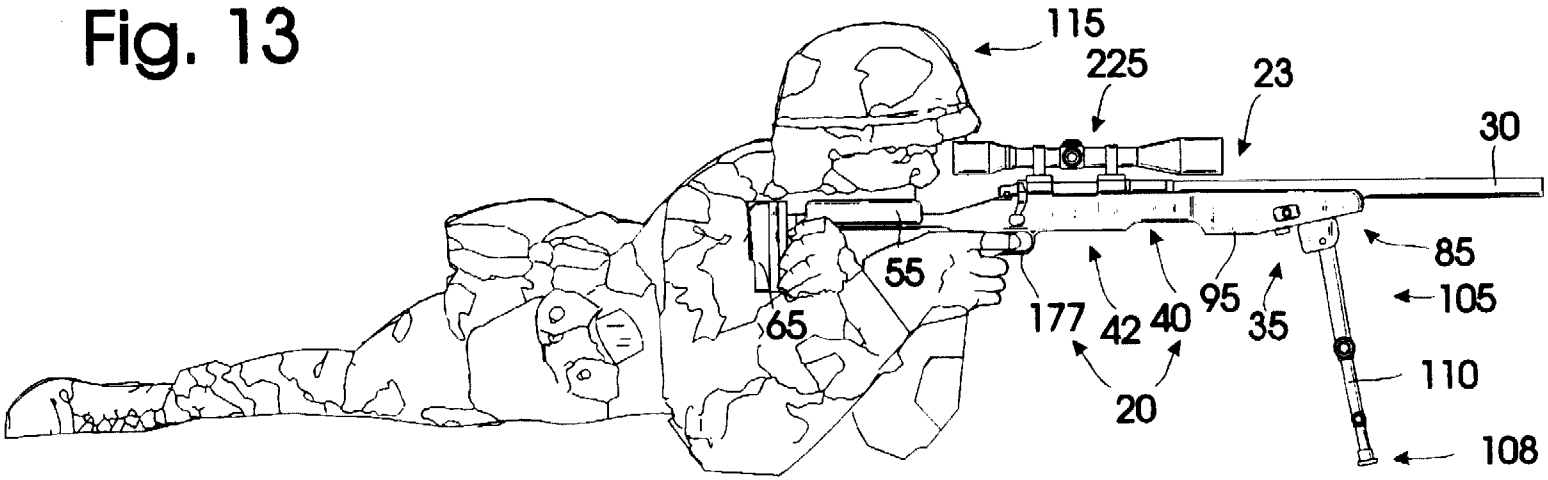
FIG. 13 is a side environmental view of our rifle stock being used in conjunction with a bipod.
Figure 14:
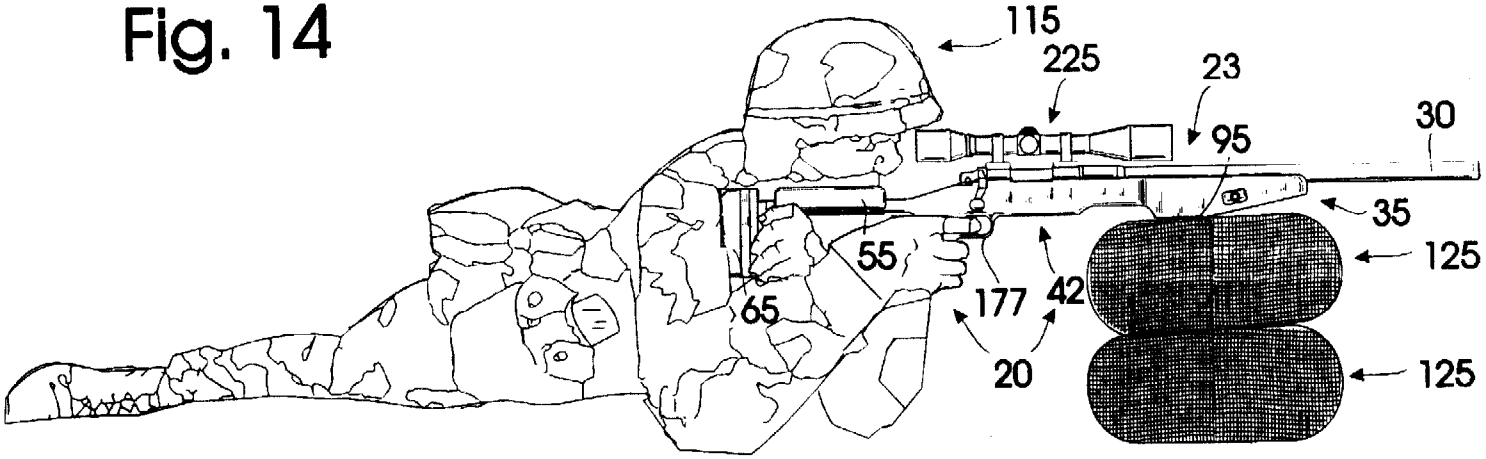
FIG. 14 is a side environmental view illustrating use of the serrations of the forearm on sandbags; and, FIG. 15 is a side environmental view illustrating use of the angled portion of the forearm of our rifle stock in conjunction with a solid support.
Figure 15:
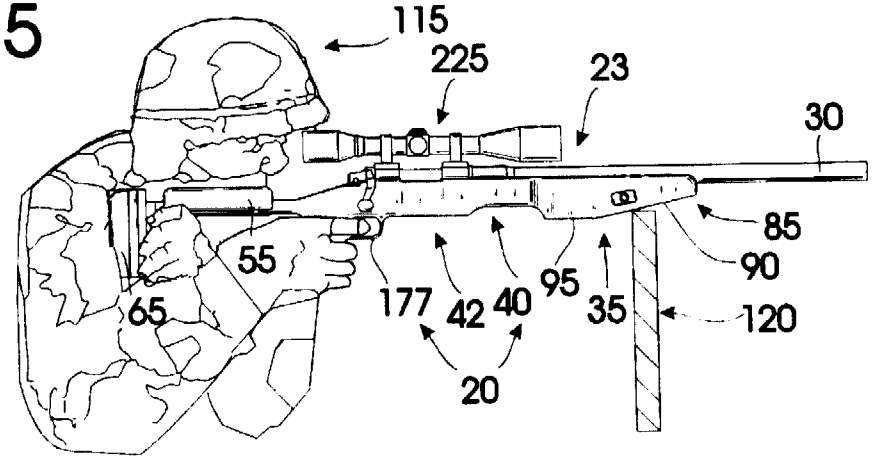

The forearm portion 35 of the stock 20 is relatively wide and has a flat bottom 80. In the preferred embodiment it is approximately two and a half inches wide. The forearm 35 comprises a forend 85 comprising an angled base 90 and a relatively flat serrated base portion 95 extending rearwardly from the forend 85. In the preferred embodiment the angled base defines approximately a ten degree angle off horizontal. A rail 100 is disposed within the angled base 90 of the forend portion 85. The rail defines a generally "T" shaped channel 102 to receive and mount accessories, such as a bipod 105 or off hand grip or rest (FIG. 10). When folded the distal ends 108 of the legs 110 of a folding bipod 105 mounted on the rail 100 are disposed along the barrel 30 of the rifle 23 (FIG. 12). The flat base portion 95 of the forearm 35 is disposed generally parallel to the bore of a rifle barrel 30 mounted in the stock 20. When a bipod 105 is not employed the angled forearm 85 allows a shooter 115 to adjust elevation by sliding the angled portion 85 of the forearm 35 forward and back on a support 120, such as a chair back or window frame (FIG. 12). Also, when a bipod 105 is not installed or is folded up, the serrated flat portion 95 of the forearm 35 provides stability and the serrations help prevent slippage when resting on a supporting surface such as a sandbag 125 (FIG. 11). A first through-stock swivel stud 130 is disposed in a through-stock orifice 132, defined generally perpendicular to the barrel 30 of the rifle 23, through the forend portion 85 of the forearm 35. Recesses 135 are defined in the sides 140 of the forearm 35 about the orifice to maintain the heads 145 of the stud 130, generally flush with the surface of the forearm 35 sides 140.

A relatively narrow carry portion 40 extends rearwardly from the forearm 35. The carry portion 40 has a width and thickness less than the forearm portion 35. The carry portion 40 facilitates balanced one hand carrying of the rifle 23. A bed 150 is defined along the top of the forearm 35 and carry portions of the stock 20 to receive the barrel 30 of a rifle 23. Preferably, the width of all the stock reward of the forearm 35 is approximately one and one half inches.

The action mounting portion 42 extends rearwardly from the carry portion 40. The action mounting portion 42 defines a hollow 155 to accept the receiver and a bed 160 to accept the action 25 of the rifle 23 mounted to the stock 20. The action mounting portion 42 has a thickness greater than the carry portion 40 and a width generally equal to the carry portion 40.

An angled relatively vertical, stippled grip portion 45 extends rearwardly and downwardly from the receiver portion of the stock generally adjacent a trigger 165 of the rifle 23 mounted in the stock 20. Preferably the grip 45 is disposed at approximately ten degrees off vertical. The grip portion 45 has a width generally equal to the carry portion 40. Preferably the grip portion 45 defines a sealable balance weight 168 receptive cavity 170. The balancing weight 168 disposed in the cavity 170 is varied as desired or as needed for barrel length. The weight provides the stock 20 with added weight which dampens recoil. The weight 168 can be epoxied or similarly fixed in place to prevent shifting. The cavity 170 is sealed by a cap 172. The cap screws 175 are countersunk for flush mounting to avoid snagging. A trigger guard 177 extends from the receiver portion 42 to the grip portion 45.

An open rear stock portion 50 having a width generally equal to the carry portion 40 extends rearwardly from the grip portion 45. The rear stock portion 50 comprises generally parallel rearwardly extending upper and lower braces 180 and 182, the rear ends 185 and 187 of which are bridged by a butt portion 75. The upper brace portion 180 extends rearwardly from an upper portion 190 of the grip portion 45. The upper brace portion 180 defines a plurality of threaded orifices 192 to receive at least one mounting screw 195 extending through a forwardly and rearwardly displaceable interchangeable cheekpiece 55 disposed about the upper brace 180. A lower brace portion 182 extends rearwardly from a lower portion 197 of the grip portion 45. The lower brace portion 182 defines a second, lower relatively flat serrated base 200, generally parallel with the bore of the rifle 23. A butt portion 75 extends, generally vertically and perpendicularly, between reward extents 185 and 187 of the brace portions 180 and 182. An off hand hold notch is defined within the open stock. The butt portion 75 defines a plurality of uniformly spaced apart, rearwardly opening, threaded orifices 202 to receive butt plate 65 and spacer 70 mounting screws 204. These orifices 202 are defined in a plate 205 embedded in the butt portion 75 of the stock 20. A second through-stock swivel stud 210 is disposed in a through-stock orifice 212 defined in the butt portion 75 of the stock. The orifice 212 and swivel stud 210 are disposed generally perpendicular to the barrel 30 of the rifle 23. Recesses 215 are defined in the sides 220 of the butt portion 75 around the through-stock orifice to maintain the heads 222 of the stud 210 generally flush with the sides 220 of the butt portion 75.

A vertically displaceable butt plate or pad 65 is mounted to the rear of the stock 20 by screws 204 threadably received by the butt portion 75 threaded orifices 202. Removable, vertically displaceable spacers 70 are disposed between the butt plate 65 and the rear of the butt portion 75. The spacers 70 define mounting screw through-holes. The spacers 70 are removably disposed to adjust the length of pull of the rifle 23.

The interchangeable cheekpiece 55 is disposed over the top or comb 60 of the upper brace 180, held in place longitudinally by a single bolt 195. The shooter 115 can select a cheekpiece 55 having a thickness which best suits him and position it along the comb 60 of the stock at the best position for him. Additionally, if the shooter 115 employs scope rings a thicker cheekpiece can be used which in conjunction with the vertically adjustable butt plate or pad 65 will provide proper alignment for the shooter's eye and the scope 225.

The novel through stock swivel studs 130 and 210 are flush mounted in recesses 135 and 210 for superior strength and performance. The through stock swivels 130 and 210 horizontally pass through the stock 20 allowing a sling 230 to be disposed along the length of the stock 20. A sling 230 so disposed allows the relatively flat stock 20, mounting a rifle 23, to be carried relatively flat against a shooters 115 back. This provides greater maneuverability through underbrush, heavy vegetation or the like. The sling 230 so mounted allows easier wrapping by the shooter 115 to provide stability. By passing entirely through the stock 20, and since both ends of the studs 130 and 210 provide heads to receive swivels, the studs 130 and 210 allow a sling 230 to be mounted to either side of the stock 20 as preferred by the user 115. Another advantage presented by the through stock swivels 130 and 210 is superior strength. The through stock swivel studs 130 and 210 have a relatively great bearing area, along the length of the stud penetrating the stock 20. Conversely, the swivels for conventional stocks are mounted in place by screws or a stud screwed directly into the material of the stock. The swivels 235 mounted on our studs 130 and 210 are disposed within the recesses 135 and 215. The recesses 135 and 215, and swivel studs 130 and 210 are preferably disposed in the forend portion 85 of the forearm 35 and in the butt portion 75. These recesses keep the swivel stud heads 145 and 222 retracted to help prevent snagging both when in use and when not in use. The recessed swivel stud heads 145 and 222 are well adapted to accept quick release swivels 235. Finally, the through-stock swivel studs 130 and 210 are less likely to bind than conventional flush mounted studs. The greater length of the studs 130 and 210 also help to insure that they will be free to rotate when necessary and not bind.

The preferred embodiment of our stock 20 is injection molded from Dow® Rynite®. Rynite® is a thermoplastic polyester resin which contains uniformly dispersed glass or glass/mineral fibers in polyethylene terephthalate or polybutylene terephthalate. It is specially formulated for rapid crystallization during injection-molding. This material has proven to be an exceptional material for gun stocks and the like. However, alternative embodiments of our stock 20 can be made of a variety of materials or composites of materials. Specifically, fiberglass, light weight metal or carbon fiber composites are foreseeable.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An integral user configurable sniper rifle stock, said stock comprising:

a relatively wide forearm portion, said forearm portion comprising:

a forend having an angled base;

a rail disposes within said base said rail defining a generally "T" shaped channel to receive and mount accessories;

a first relatively flat base portion extending rearwardly from said forend, said flat portion disposed generally parallel to a bore of a rifle mounted to said stock;

a relatively narrow carry portion extending rearwardly of said forearm, said carry portion having a width and thickness less than said forearm portion;

a bed defined along a top of said forearm portion and said carry portion for receiving the barrel of said rifle;

an action mounting portion extending rearwardly from said carry portion, said action mounting portion defining a hollow to accept the receiver and action of said rifle mounted to said stock and said action mounting portion having a thickness greater than said carry portion;

an angled relatively vertical grip portion extending rearwardly and downwardly from said receiver portion and disposed generally adjacent a trigger of said rifle mounted in said stock: and, an open rear stock portion defined by an upper brace portion extending rearwardly from an upper portion of said grip portion, a lower brace portion extending rearwardly from a lower portion of said grip portion and a butt portion extending generally vertically between reward extents of said brace portions, said lower brace portion defining a second, lower relatively flat base portion generally parallel with said bore of said rifle.

2. The sniper rifle stock as defined in claim 1 wherein said flat base portions are serrated.

3. The sniper rifle stock as defined in claim 2 further comprising:

a through-stock swivel stud disposed in a through-stock orifice defined in said forearm, generally perpendicular to a barrel of said rifle; and, a through-stock swivel studs disposed in a through-stock orifice defined generally perpendicular to said barrel of said rifle through said butt portion.

4. The sniper rifle stock as defined in claim 3 further comprising recesses defined in sides of said forearm and said butt portion about said orifices to flush mount said stud.

5. The sniper rifle stock as defined in claim 4 wherein said grip portion defines a sealable balance weight receptive cavity.

6. The sniper rifle stock as defined in claim 5 further comprising a vertically displaceable butt plate disposed on a rear of said butt portion.

7. The sniper rifle stock as defined in claim 6 further comprising vertically displaceable spacers removably disposed between said butt portion and said butt plate.

8. The sniper rifle stock as defined in claim 7 wherein said butt portion comprises a plurality of paired uniformly spaced apart, rearwardly opening threaded orifices to receive mounting screws for selectively mounting said butt plate and said spacers in a desired vertical configuration.

9. The sniper rifle stock as defined in claim 8 further comprising a forwardly and rearwardly displaceable interchangeable cheekpiece disposed about said upper brace.

10. The sniper rifle stock as defined in claim 9 wherein said upper brace portion defines at least one threaded orifice to receive at least one mounting screw extending through said cheekpiece.

11. The sniper rifle stock as defined in claim 10 further comprising a trigger guard portion extending from said receiver portion to said grip portion.

12. The sniper rifle stock as defined in claim 11 wherein said grip portion is stippled.

13. The sniper rifle stock as defined in claim 12 wherein said carry portion, action mounting portion, grip portion and rear stock portion have the same width.

14. The sniper rifle stock as defined in claim 13 wherein said accessories include a folding bipod displaceably mounted to said rail, when folded distal ends of legs of said bipod being disposed along said barrel of said rifle.

15. An user configurable sniper rifle stock adapted to mount a rifle action and barrel, said stock comprising:

a relatively wide forearm portion, said forearm portion comprising:

a forend comprising an angled base;

a rail disposed within said base said rail defining a generally "T" shaped channel to receive and mount accessories; and, a first relatively flat base portion extending rearwardly from said forend, said flat portion disposed generally parallel to a bore of a rifle mounted to said stock;

a relatively narrow carry portion extending rearwardly of said forearm, said carry portion having a width and thickness less than said forearm portion;

a bed defined along a top of said forearm portion and said carry portion for receiving the barrel of said rifle;

an action mounting portion extending rearwardly from said carry portion, said action mounting portion defining a hollow and bed to accept the receiver and action of said rifle mounted to said stock, said action mounting portion having a thickness greater than said carry portion and a width generally equal to said carry portion;

an angled relatively vertical, grip portion extending rearwardly and downwardly from said receiver portion and disposed generally adjacent a trigger of said rifle mounted in said stock, said grip portion having a width generally equal to said carry portion and said grip portion defining a sealable balance weight receptive cavity;

a trigger guard portion extending from said receiver portion to said grip portion;

an open rear stock portion having a width generally equal to said carry portion, said rear stock portion comprising:

an upper brace portion extending rearwardly from an upper portion of said grip portion, said upper brace portion defining at least one threaded orifice to receive at least one mounting screw extending through a forwardly and rearwardly displaceable interchangeable cheekpiece disposed about said upper brace;

a lower brace portion extending rearwardly from a lower portion of said grip portion, said lower brace portion defining a second, lower relatively flat base portion generally parallel with said bore of said rifle; and, a butt portion extending generally vertically between reward extents of said brace portions, said butt portion comprising a plurality of uniformly spaced apart, rearwardly opening threaded orifices to receive butt plate and spacer mounting screws, a vertically displaceable butt plate disposed on a rear of said butt portion by screws threadably received by said butt portion threaded orifices; and, removable, vertically displaceable spacers disposed between said butt plate and said rear of said butt portion, said spacers defining mounting screw through-holes and removably disposed to adjust the length of pull of said rifle.

16. The sniper rifle stock as defined in claim 15 further comprising:

a through-stock swivel stud disposed in a through-stock orifice defined in said forearm, generally perpendicular to a barrel of said rifle;

a through-stock swivel studs disposed in a through-stock orifice defined generally perpendicular to said barrel of said rifle through said butt portion; and recesses defined in sides of said forearm and said butt portion about said orifices to flush mount said stud.

17. The sniper rifle stock as defined in claim 16 wherein said flat base portions are serrated.

18. The sniper rifle stock as defined in claim 17 wherein said grip portion is stippled.

19. The sniper rifle stock as defined in claim 18 wherein said accessories include a folding bipod displaceably mounted to said rail, when folded distal ends of legs of said bipod being disposed along said barrel of said rifle.

20. An integral user configurable sniper rifle stock adapted to mount a rifle action and barrel, said stock comprising:

a relatively wide forearm portion, said forearm portion comprising:

a forend comprising an angled base;

a rail disposes within said base said rail defining a generally "T" shaped channel to receive and mount accessories;

a first relatively flat serrated base portion extending rearwardly from said forend, said flat portion disposed generally parallel to a bore of a rifle mounted to said stock;

a through-stock swivel stud disposed in a through-stock orifice defined generally perpendicular to a barrel of said rifle, recesses defined in sides of said forearm about said orifice to flush mount said stud;

a relatively narrow carry portion extending rearwardly of said forearm, said carry portion having a width and thickness less than said forearm portion;

a bed defined along a top of said forearm portion and said carry portion for receiving the barrel of said rifle;

an action mounting portion extending rearwardly from said carry portion, said action mounting portion defining a hollow and bed to accept the receiver and action of said rifle mounted to said stock, said action mounting portion having a thickness greater than said carry portion and a width generally equal to said carry portion;

an angled relatively vertical, stippled grip portion extending rearwardly and downwardly from said receiver portion and disposed generally adjacent a trigger of said rifle mounted in said stock, said grip portion having a width generally equal to said carry portion and said grip portion defining a sealable balance weight receptive cavity;

a trigger guard portion extending from said receiver portion to said grip portion;

an open rear stock portion having a width generally equal to said carry portion, said rear stock portion comprising:

an upper brace portion extending rearwardly from an upper portion of said grip portion, said upper brace portion defining at least one threaded orifice to receive at least one mounting screw extending through a forwardly and rearwardly displaceable interchangeable cheekpiece disposed about said upper brace;

a lower brace portion extending rearwardly from a lower portion of said grip portion, said lower brace portion defining a second, lower relatively flat serrated base portion generally parallel with said bore of said rifle;

a butt portion extending generally vertically between reward extents of said brace portions, said butt portion comprising a plurality of uniformly spaced apart, rearwardly opening threaded orifices to receive butt plate and spacer mounting screws, at least one through-stock swivel stud disposed in at least one through-stock orifice defined generally perpendicular to said barrel of said rifle through said butt portion; and, recesses defined in sides of said butt portion about said orifice to flush mount said stud;

a vertically displaceable butt plate disposed on a rear of said butt portion by screws threadably received by said butt portion threaded orifices; and, removable, vertically displaceable spacers disposed between said butt plate and said rear of said butt portion, said spacers defining mounting screw through-holes and removably disposed to adjust the length of pull of said rifle.

21. The sniper rifle stock as defined in claim 20 wherein said accessories include a folding bipod displaceably mounted to said rail, when folded distal ends of legs of said bipod being disposed along said barrel of said rifle.

* * * * *